US006547578B2

(12) United States Patent
Huang

(10) Patent No.: US 6,547,578 B2
(45) Date of Patent: Apr. 15, 2003

(54) MULTI-DIRECTION INSERTION SOCKET WITH CONDUCTOR STRUCTURE

(75) Inventor: Chyong-yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 0 days.

(21) Appl. No.: 09/986,547

(22) Filed: Nov. 13, 2001

(65) Prior Publication Data

US 2002/0177339 A1 Nov. 28, 2002

(30) Foreign Application Priority Data

May 24, 2001 (TW) ..... 90208475 U

(51) Int. Cl.[7] ..... H01R 27/00
(52) U.S. Cl. ..... 439/222; 439/224
(58) Field of Search ..... 439/222, 224

(56) References Cited

U.S. PATENT DOCUMENTS 1,226,433 A * 5/1917 Young ..... 439/222
1,453,590 A * 5/1923 Mayer ..... 439/222
1,675,016 A * 6/1928 Alpaugh ..... 439/222
1,796,290 A * 3/1931 Kulka ..... 439/222
5,007,848 A * 4/1991 Lee ..... 439/222
5,170,117 A * 12/1992 Chio ..... 439/222
5,616,041 A * 4/1997 Brown et al. ..... 439/222

* cited by examiner

*Primary Examiner*—Gary Paumen
(74) *Attorney, Agent, or Firm*—Rosenberg, Klein & Lee

(57) ABSTRACT

A multi-direction insertion socket with its conductor structure permitting insertion of plugs from different directions at the same time essentially by having the conductor to contain a clamping part to restrict an inserted pin from a plug with the clamping part including two clamping tabs, at least one clamping tabs extends and winds into form an additional clamping tab to further form an additional clamping part with the clamping tab that extends for various plugs to be inserted into the clamping tabs provided by the conductor at the same time to draw the power.

7 Claims, 12 Drawing Sheets

MULTI-DIRECTION INSERTION SOCKET WITH CONDUCTOR STRUCTURE

BACKGROUND OF THE INVENTION (a) Field of the Invention

The present invention relates to a multi-direction insertion socket with its conductor structure, and more particularly, to one that allows insertion by various pins of various types of plug at the same time from different directions for saving mounting space in the socket and consumption of copper conductor material.

(b) Description of the Prior Art:

Whereas, a power socket is usually mounted at a fixed location for lighting fixtures and electric appliances at home, an extension wire is required for any electric appliance with its power cable in limited length that is located far away from the power socket. To cope with serving at the same time for more than an electric appliance, the extension wire is adapted with a one-pin or multiple-pin socket to be place at a location remote from the power source. To have optimal use of the space available in the socket, most of the sockets are designed with their outlets to allow insertion of plugs from different directions, generally, from top or both sides of the socket. An example of such socket permitting insertion from different directions is as illustrated in FIGS. 12 and 13 of the accompanying drawings. It is essentially composed of multiples of an outlet modulus (A) and a switching modulus (B) connected to the socket body (C) with said multiple outlet modulus mounted to the socket body (C) from different directions for plugs to draw the power from different directions.

However, several defects are found with the structure of the prior art essentially due to:

1. A great demand on the interior space of the socket is relatively larger since it has to accommodate multiple socket modulus with their outlets facing different directions. In turn, the entire volume of the socket could get excessively large and higher costs of production and materials for the body of the socket.
2. Said structure requires use of multiple outlet modulus, that is, each outlet modulus needs one set of conduction copper materials. In the example as illustrated, there are a total of twelve units of outlets mounted to the body of the socket, so that twelve sets of outlet modulus, thus twelve sets of conduction copper materials are required. Accordingly, as the utility increases, the general production cost is increased due to conduction copper material happens to be quoted at higher price.

SUMMARY OF THE INVENTION

The primary purpose of the present invention is to provide a multi-direction insertion socket with its conductor structure that permits insertion of plugs from different directions by using a unitary set of conductor for the socket to receive insertion of plugs from different directions. To achieve the purpose, said conductor contains a clamping part to restrict pins of a plug. Said clamping part contains two clamping tabs. At least one clamping tab extends and winds to form an additional clamping tab to further form an additional part with the clamping part that extends to receive insertion of various plugs inserted from different directions at the same into the clamping parts.

DETAILED DESCRIPTION OF THE PREFERRED EMBODIMENTS

The present invention is applicable to extension sockets generally available in the market or any other particular form of socket unit, i.e. to any socket with outlets to simultaneously receive multiples or variable plugs.

The conductor of the present invention made of copper with good conductivity is essentially composed of a clamping part to restrict inserted pin from a plug. The clamping part includes two clamping tabs with at least one clamping tab curves and extends further to form an additional clamping tab to form an additional clamping part with the one it extends form.

Figure 1:
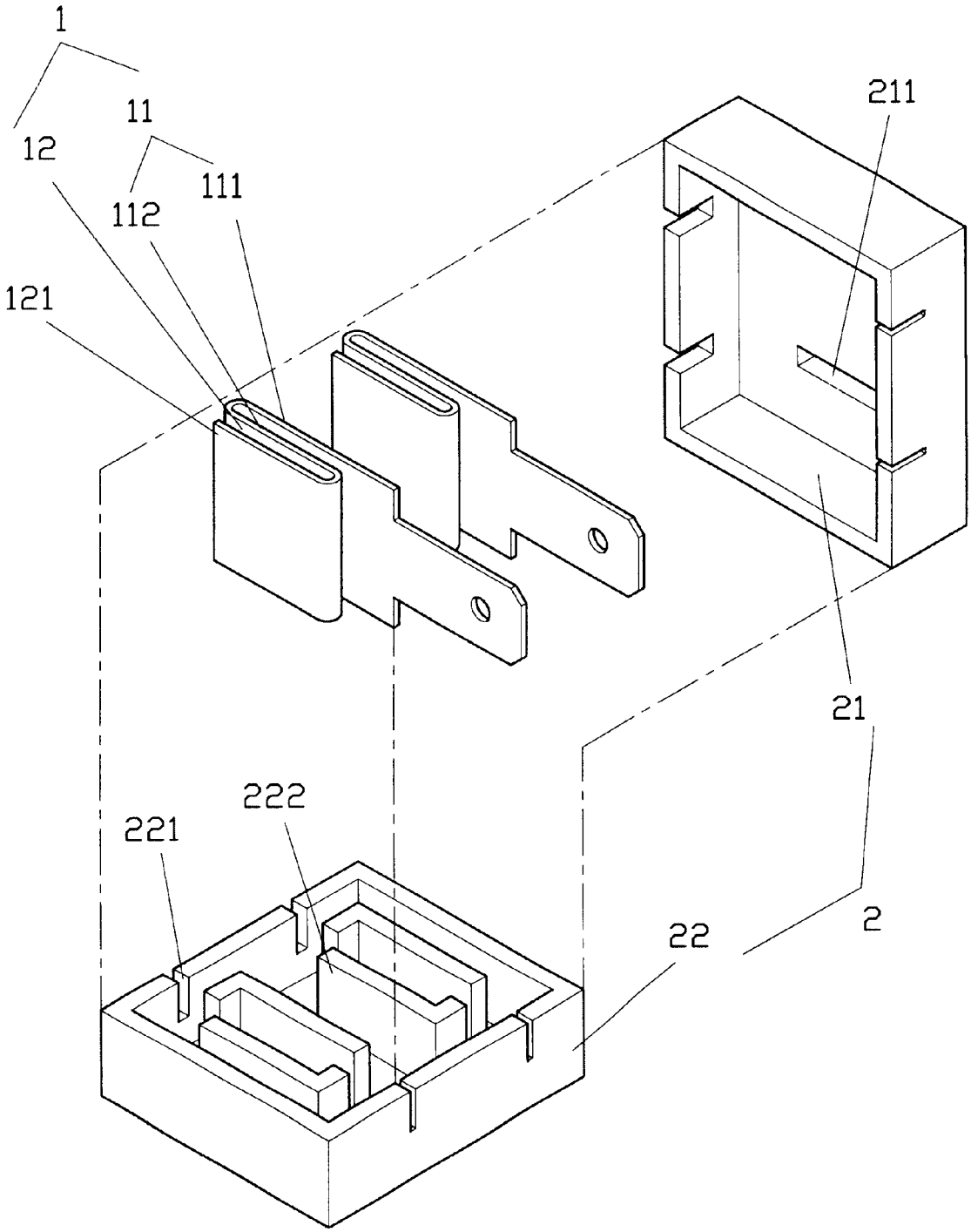
FIG. 1 is an exploded view of a structure of a first preferred embodiment of the present invention.
Figure 2:
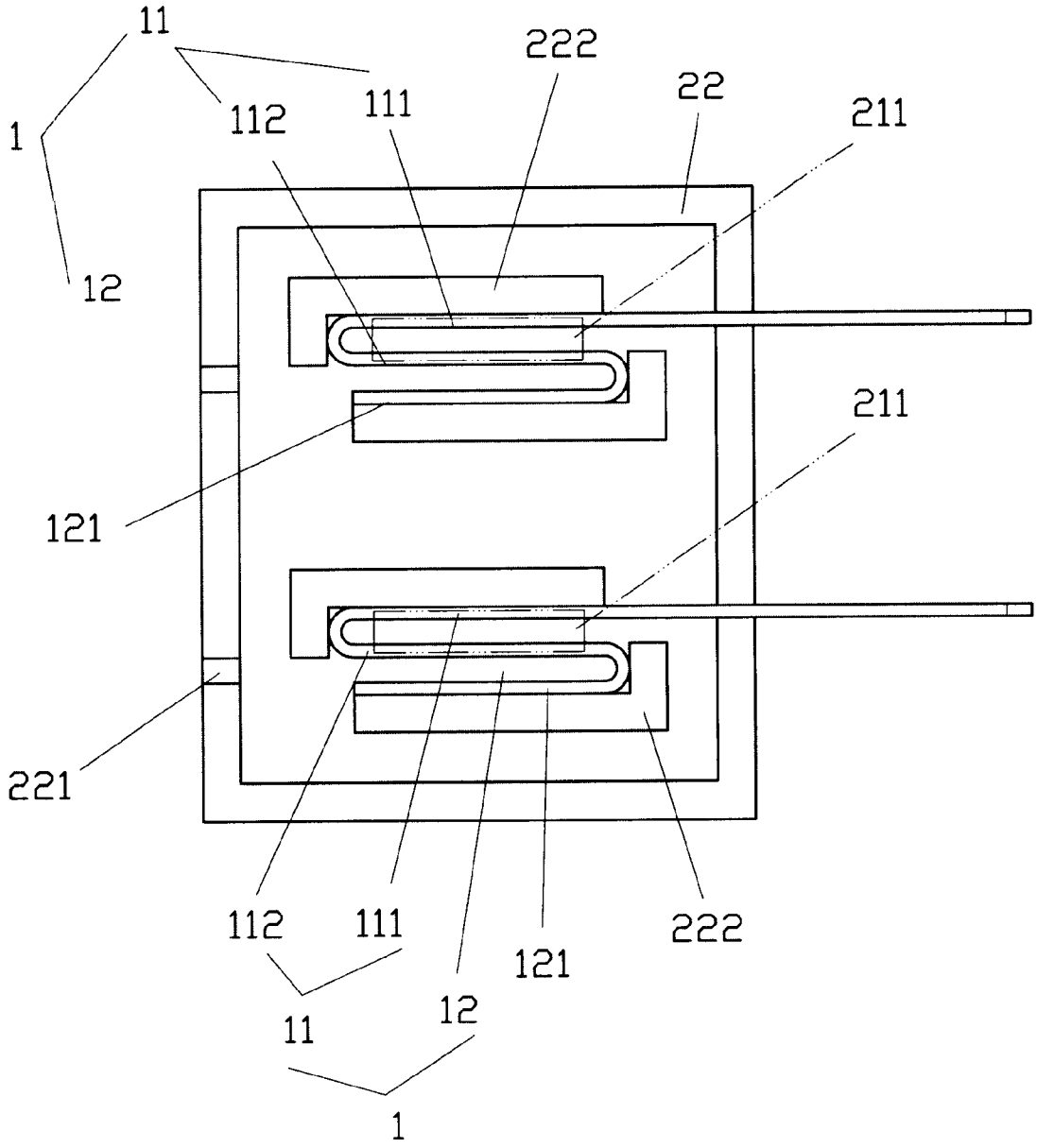
FIG. 2 is a top view of an assembly of the first preferred embodiment of the present invention.

Referring to FIGS. 1 and 2, a first preferred embodiment of the present invention applied in an independent socket is essentially composed of a conductor (1) double folded to form a U-shaped clamping part (11) by having directly curved the single conductor (1) into two relative clamping tabs (111) and (112) with either (having the clamping tab (112) as the example in this preferred embodiment) curved and extending in opposite direction from the edge of any side another clamping tab (121) forming an additional clamping part (12) for the same conductor (1) to provide two clamping parts (11) and (12).

A casing (2) comprises an upper and a lower holders (21) and (22) provided with outlets (211) and (221) with a wall (222) provided in the lower holder (22) to retain the conductor (1) in position.

Upon assembling as illustrated in FIG. 2, two conductors (1) are inserted into the lower holder (22) and retained in the wall (222) so that said outlets (221) and (211) respectively on the matched upper and lower holders (21) and (22) have said two clamping parts (11) and (12) provided on said two conductors (1) corresponding to each other while both terminals of said two conductors (1) exposed out of the casing (2) to respectively form a grounding wire contact and a fire wire contact into an independent modulus of outlet. The terminals of two conductors (1) exposed out of the casing (2) may be curved depending on the wiring to facilitate planning layout inside the socket.

Figure 3:
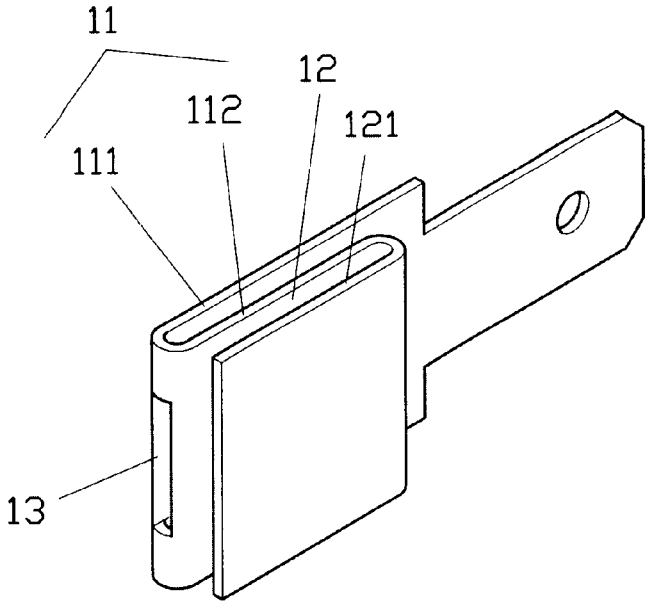
FIG. 3 is a perspective view of a structure of a second preferred embodiment of the present invention.

As illustrated in FIG. 3, the conductor (1) as shown in a second preferred embodiment of the present invention is provided a slot (13) at where the clamping part (11) conformable to the direction of the outlet (221) of the casing (2) to allow insertion of a pin of a plug. In the preferred embodiment illustrated in FIG. 3, the pins of a plug inserted laterally pass through said slot (13) to draw electricity when tightly restricted by said two clamping tabs (111) and (112) while the pins from another plug inserted vertically into the socket are tightly restricted by said two clamping tabs (112) and (121) to draw electricity.

Figure 4:
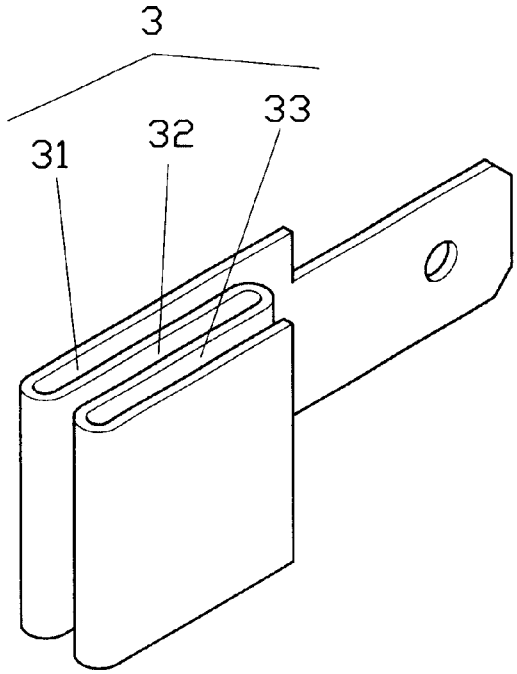
FIG. 4 is a perspective view of a structure of a third preferred embodiment of the present invention.
Figure 5:
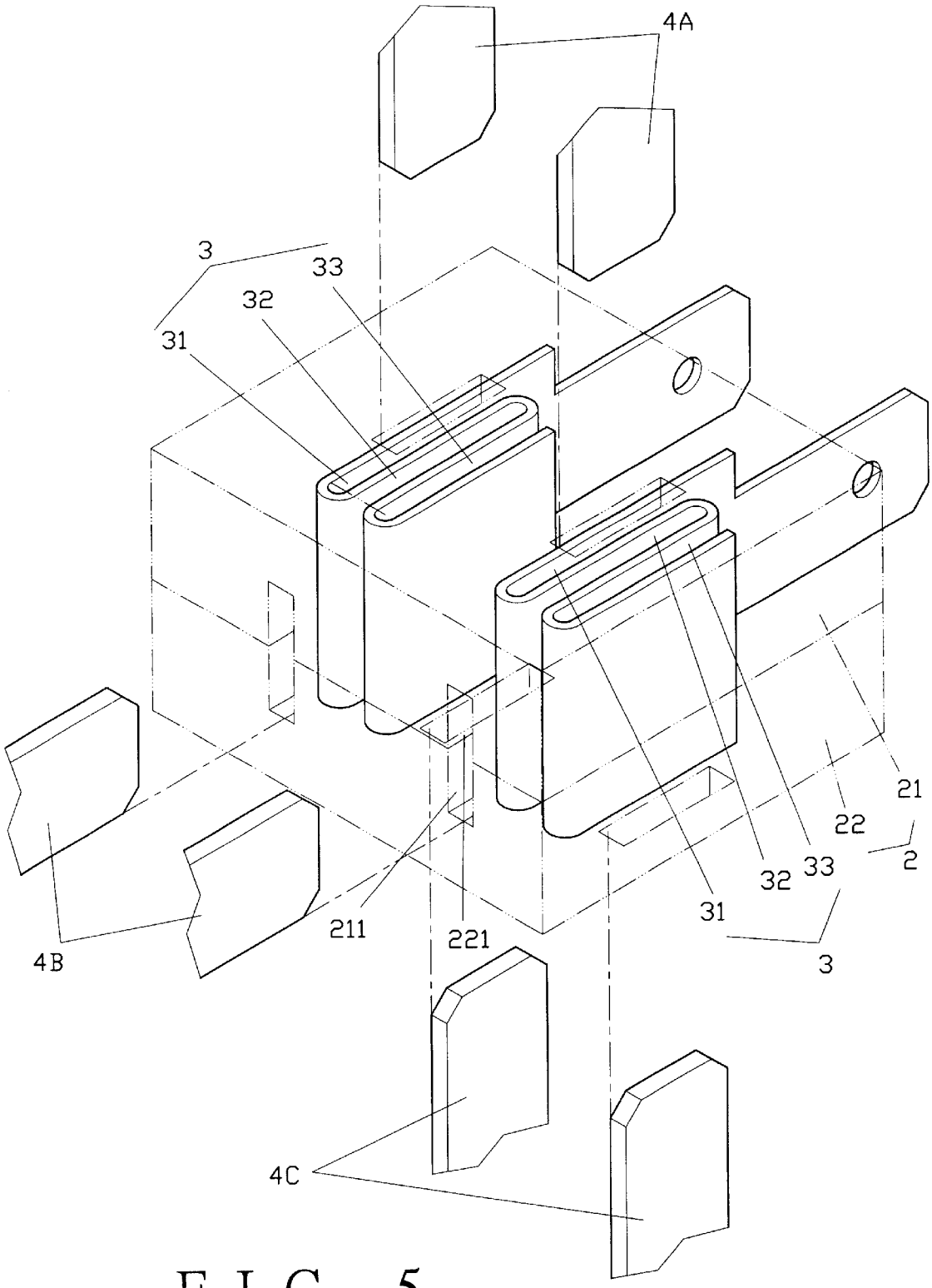
FIG. 5 is a schematic view of an assembly of the third preferred embodiment of the present invention.

In a third preferred embodiment of the present invention as illustrated in FIGS. 4 and 5, the conductor (3) is triple curved to form three clamping parts (31), (32) and (33), and the outlets (211) and (221) are provided depending on where said clamping parts (31), (32) and (33) of the conductor (3) being located for the casing (2) to receive insertion of pins (4A), (4B) and (4C) of different plugs inserted from top, front and bottom of the casing (2) since all the upper, lower and side edges of said clamping parts (31), (32) and (33) being open-end structure to allow simultaneous insertion of plugs from various directions to the same unit of conductor (3).

Figure 6:
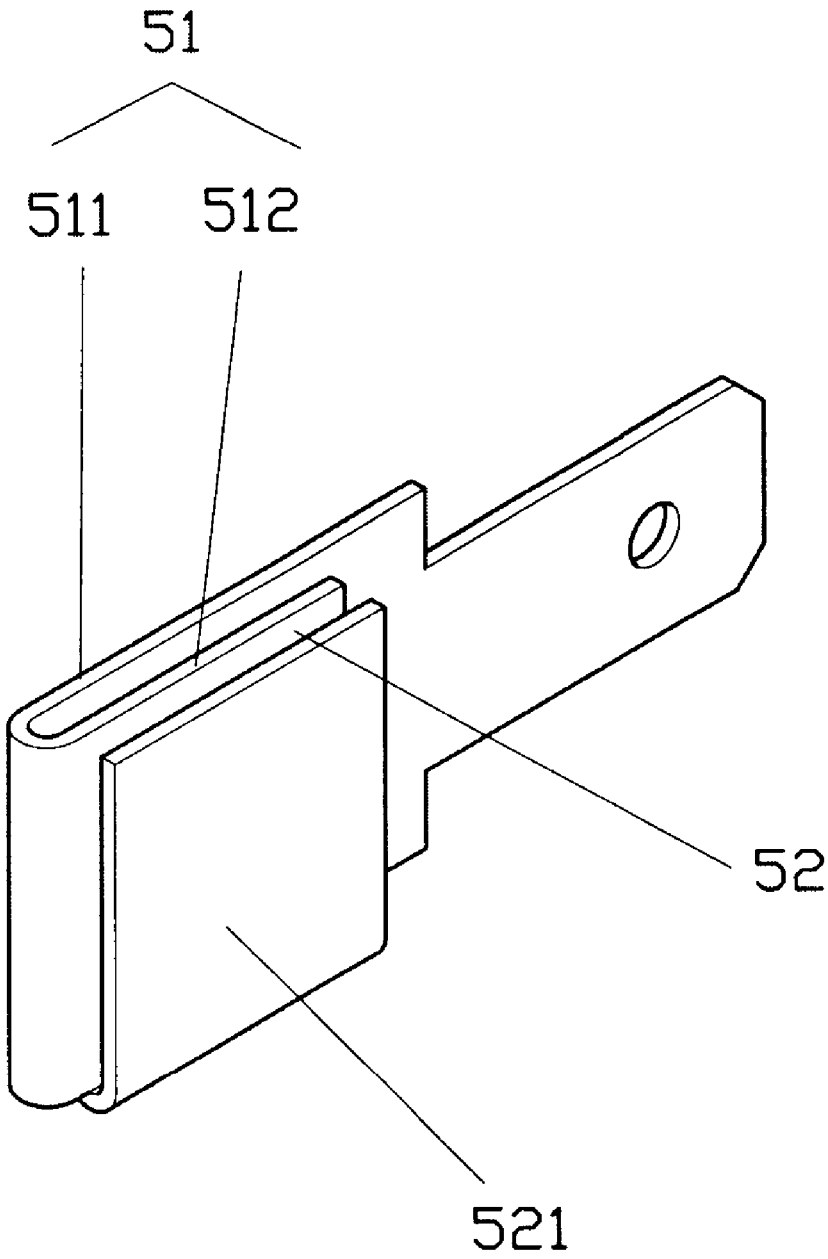
FIG. 6 is a perspective view of a structure of a fourth preferred embodiment of the present invention.

Furthermore, additional to the configuration of continuous folds from the side edge of the clamping part for the conductor of the present invention, any free edge of the clamping tab can be folded as illustrated in FIG. 6. A fourth preferred embodiment of the present invention has its conductor (5) folded to form a single clamping part (51) comprised of two clamping tabs (511) and (512) with one clamping tab (512) extended upward from its bottom edge to form an additional clamping tab (521) creating an additional clamping part (52) with the clamping tab (512) for insertion by an extra plug.

Whereas any free edge of any clamping tab may be extended further for the conductor of the present invention, a slot similar to the slot (13) as illustrated in FIG. 3 is provided to allow insertion of a pin as long as where the curve takes place permits passage of a pin from a plug without affecting the continuous fold by the clamping tab.

Figure 7:
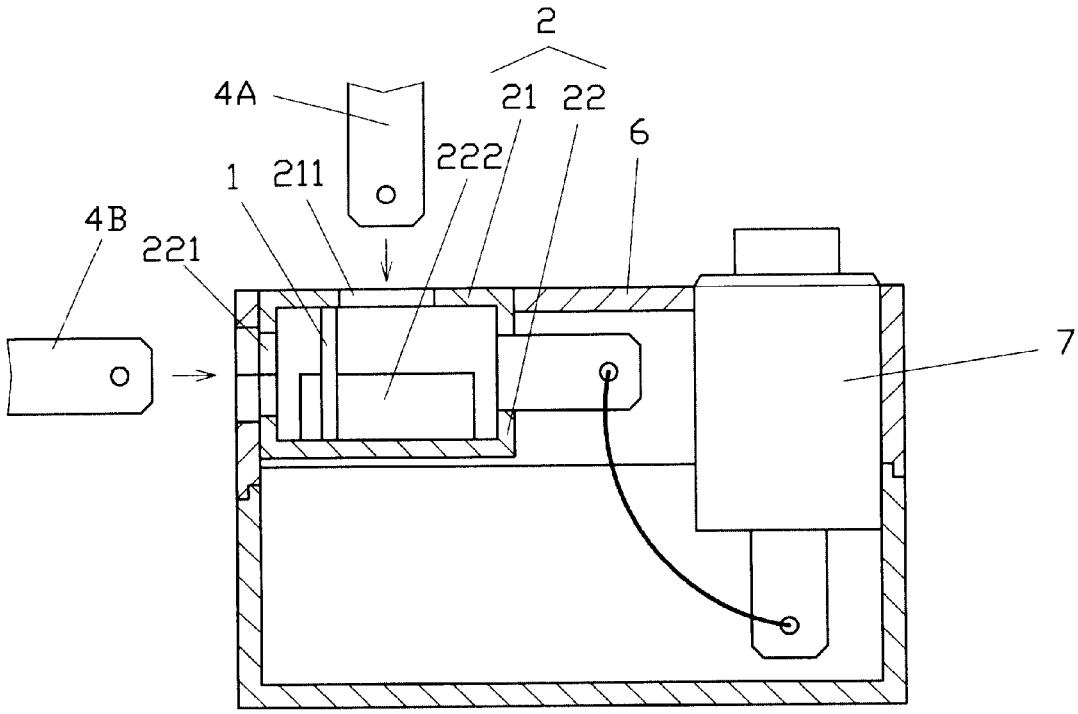
FIG. 7 is a sectional view showing that the present invention applied in a socket.
Figure 13:
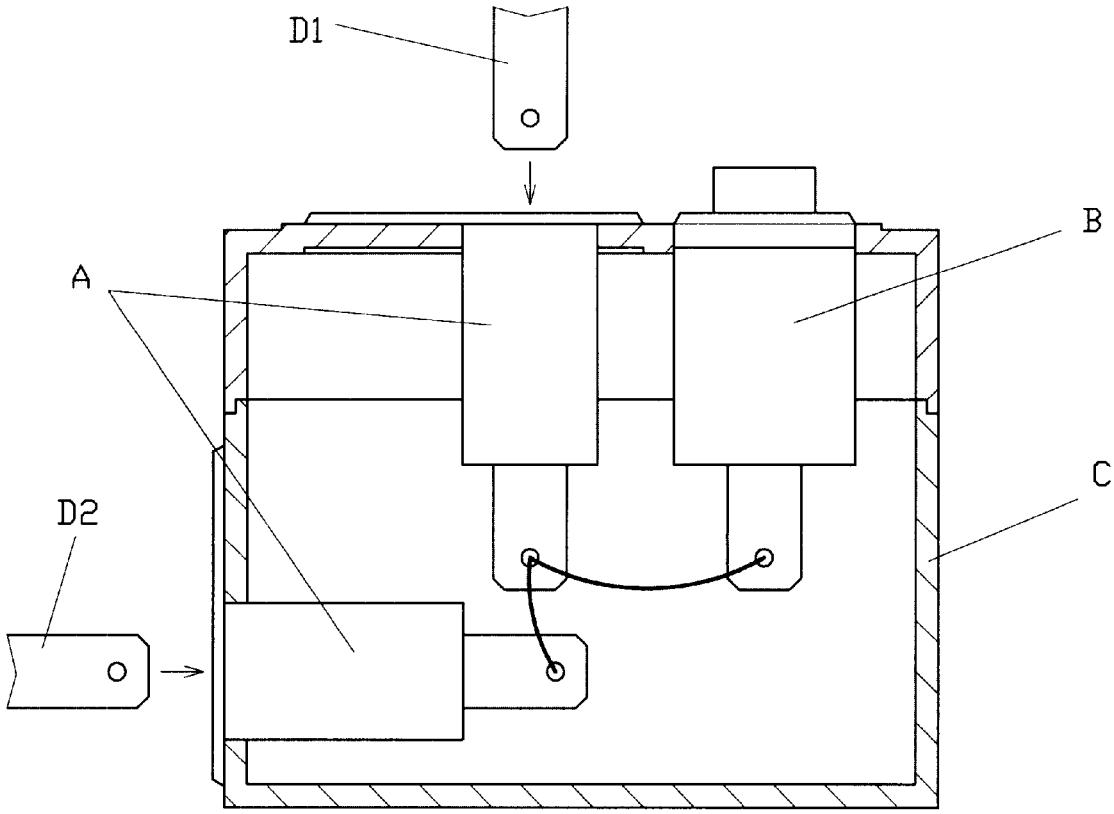
FIG. 13 (PRIOR ART)
FIG. 13 is a view showing a layout of a structure of the socket of the prior art.

By providing pins (4A), (4B) and (4C) of various plugs to be inserted into the single conductor of the present invention from two or more than two directions, both of the volume of the socket and consumption of conductor materials are significantly and efficiently reduced to the minimum. Referring to FIGS. 7 and 13 for comparison between the present invention and the prior art, wherein, both structures share their respective bodies (6) vs. (C) each provided with a switch modulus (7) vs. (B) to allow pins (4A), (4B) vs. (D1), (D2) to be inserted from two different directions at the same time. However, the structure containing the conductor (1) of the present invention saves more, either in terms of socket volume or conductor raw materials than the prior art with its socket body (C) comprised of modulus of outlet (A). In addition, the conductor (1) of the present invention also allows easier and faster assembling.

Figure 8:
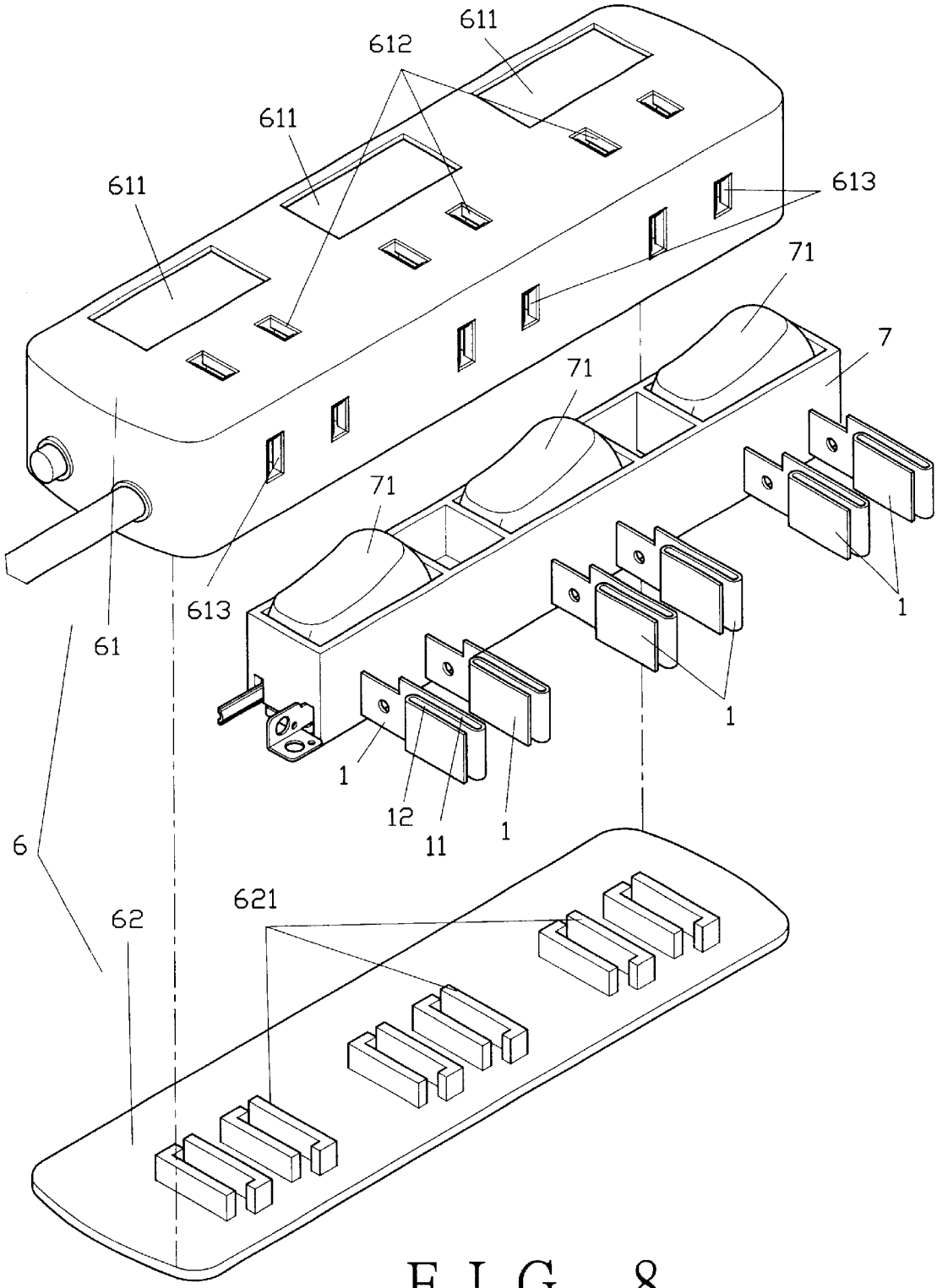
FIG. 8 is an exploded view of a structure of a fifth preferred embodiment of the present invention.
Figure 9:
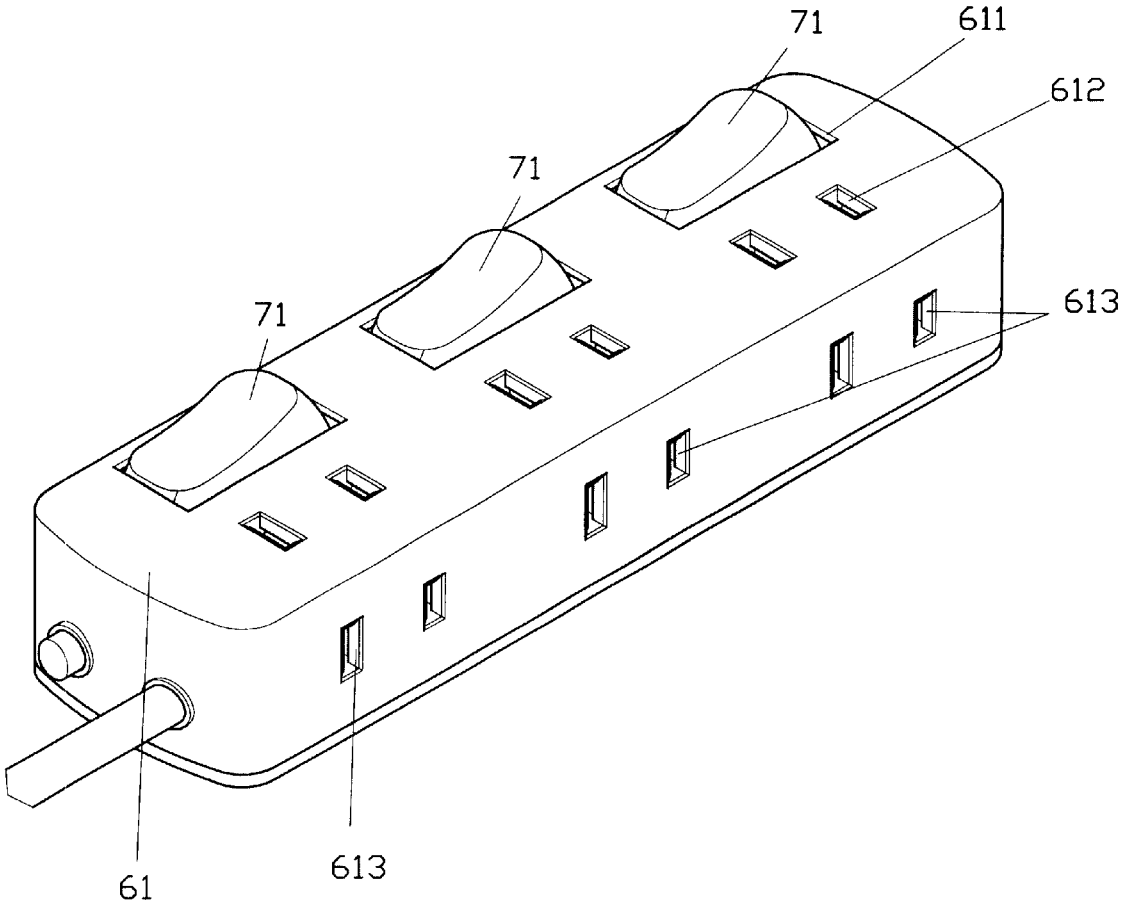
FIG. 9 is a perspective view showing an appearance of an assembly of the fifth preferred embodiment of the present invention.

As illustrated in FIGS. 8 and 9, the conductor (1) in a fifth preferred embodiment of the present invention is mounted to an extension modulus (7) integrated with multiples of switch by being directly incorporated to a socket body (6). The socket modulus (7) integrated with multiples of switch related to a holder containing multiples of outlets having extended on its edge a pair of conductors (1) in relation to each individual switch (71). The socket body (6) is formed by an upper holder (61) and a lower holder (62) mated to each other with the top of the upper holder (61) having provided an opening (611) in relation to each switch (71 ) of the socket modulus (7) integrated with multiples of switch, outlets (612) and (613) being provided in various directions respective of the relative clamping parts (11) and (12) of the conductor (1), and walls (621) being formed protruding from the surface of the lower holder (62) corresponding to where the conductor (1) is located thus to hold the conductor (1) in position, and to form a compact extension socket with multiples of outlet. In the preferred embodiment, the extension socket otherwise being provided with three pairs of outlet becoming one with at least six pairs of outlet by taking advantage of the present invention without enlarging the volume of the original extension socket effectively promotes its economic benefits.

Figure 10:
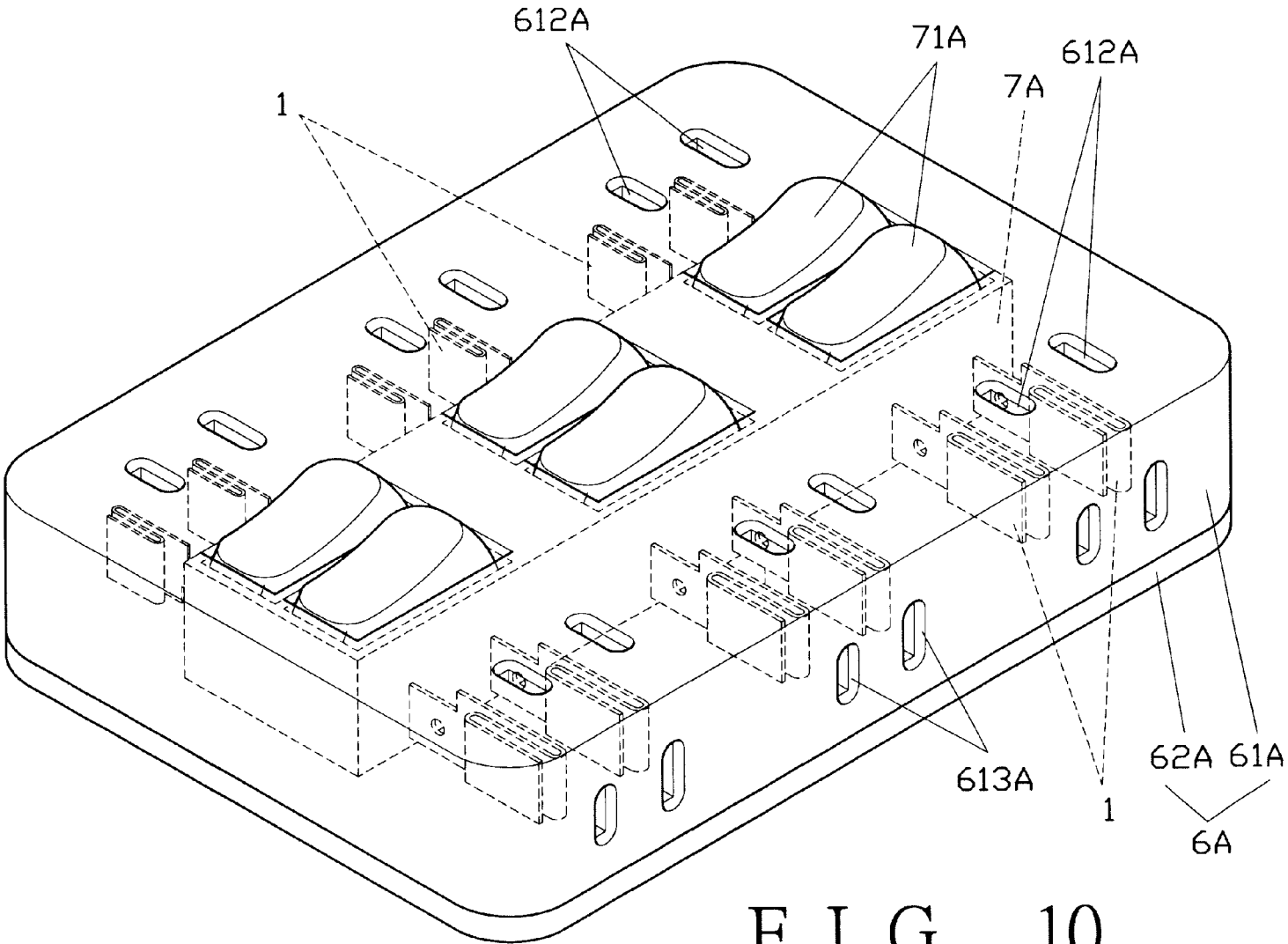
FIG. 10 is a perspective view of a structure of a sixth preferred embodiment of the present invention.
Figure 11:
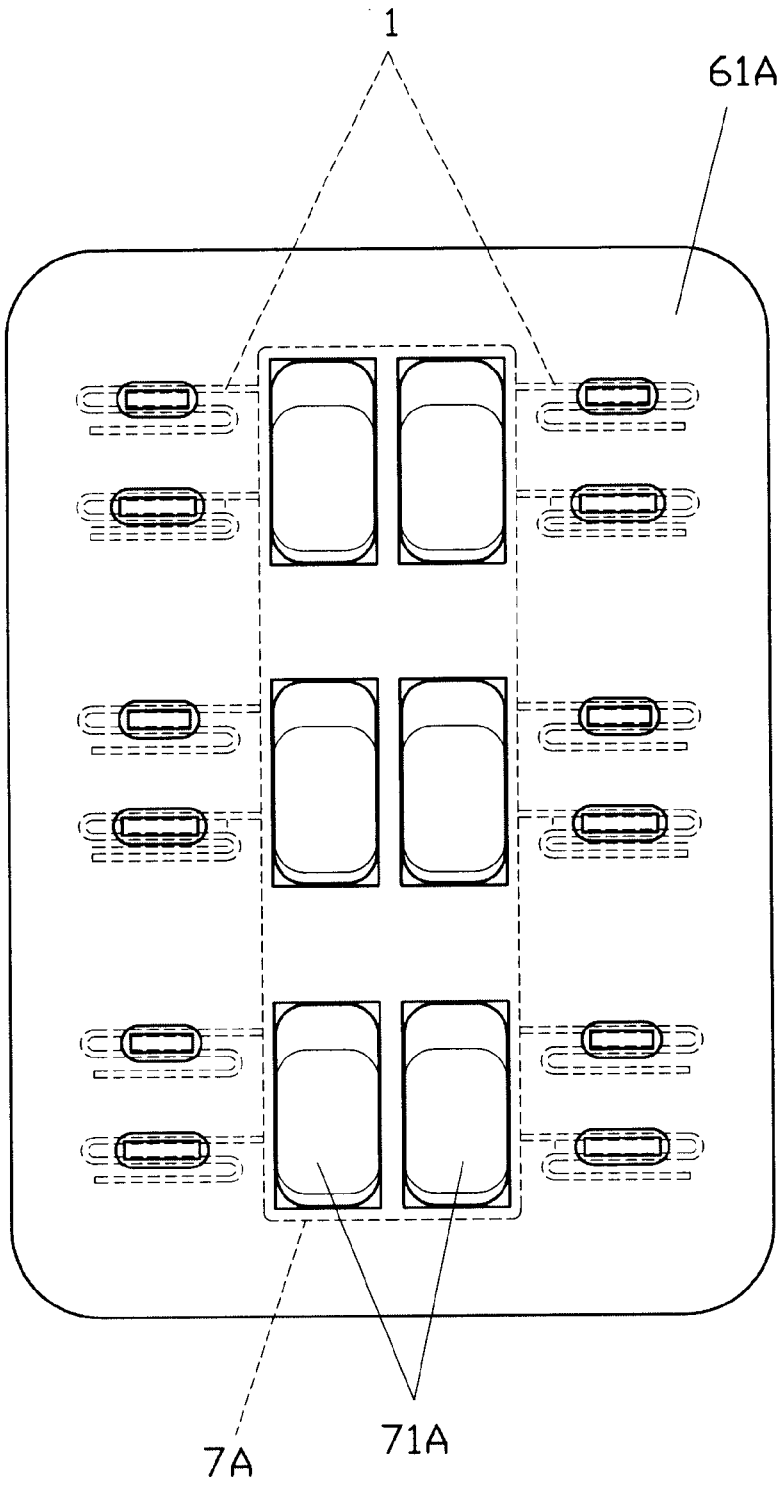
FIG. 11 is a top view of an assembly of the sixth preferred embodiment of the present invention.
Figure 12:
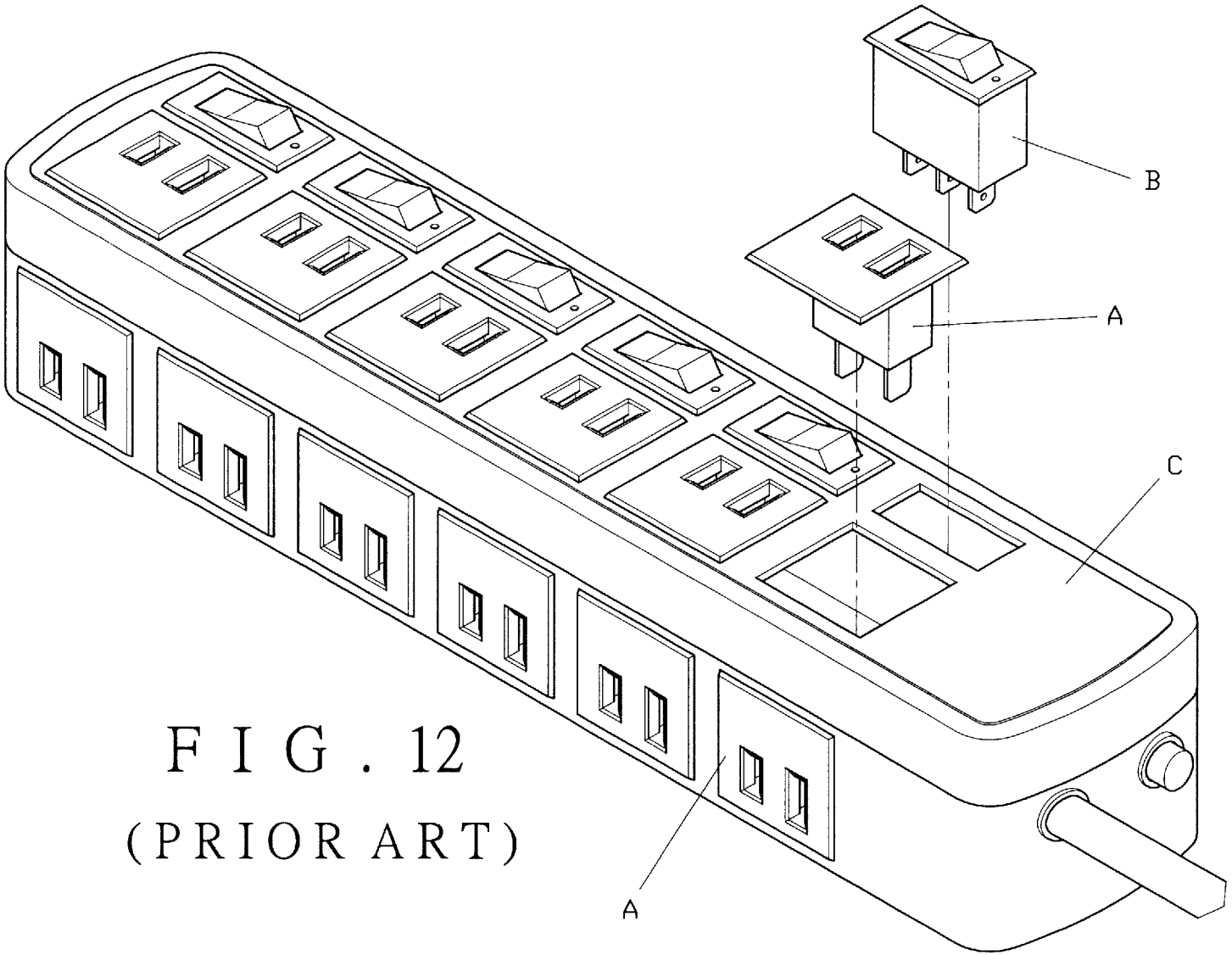
FIG. 12 (PRIOR ART)
FIG. 12 is a perspective view of a structure of a socket of the prior art.

In a sixth preferred embodiment of the present invention as illustrated in FIGS. 10 and 11, the conductor (1) is applied to a structure of an expansion socket. The teaching of the present invention is to respectively provide multiple pairs of outlet on the front and both longer sides of the socket with conductors made available inside the socket at where respective pair of outlet are located, and a switch to each pair of conductors to control whether said conductors to be conducted or not. The switch socket modulus (7A) relates to a unitary holder having extended a pair of conductor (1) from the edge of the holder in relation to each switch (71A). The socket body (6A) is composed of an upper holder (61A) and a lower holder (62A) mated to each other with an opening (611A) provided on the top of the upper holder (61A) for each switch (71A) of the switch socket modulus (7A), and multiple pairs of outlets (612A) and (613A) in different directions are provided on the top and longer sides of the switch socket modulus (7A) at where respective of the clamping part (not marked) of the conductor (1) to form a compact expansion socket with multiple pairs of outlet.

I claim:

1. A multi-direction insertion socket comprising:

at least one conductor for receiving a plug member inserted from both first and second insertion directions transversely offset one from the other, said conductor having an undulating portion forming at least a pair of clamping parts;

one said clamping part including two clamping tabs defining a channel for receiving a plug member introduced along said first direction; at least one of the clamping tabs having a folded extension forming an additional clamping tab to define thereagainst a channel of another one of the clamping parts for receiving a plug member introduced along said second direction.

2. A multi-direction insertion socket with its conductor structure as claimed in claim 1, wherein, a slot to permit pass by the pin of the plug is provided at where the clamping part of the clamping tab.

3. A multi-direction insertion socket with its conductor structure as claimed in claim 1, wherein, the clamping tab is folded in multiple places to form multiples of clamping part.

4. A multi-directional insertion socket comprising multiple pairs of outlet respectively provided on its front and longer sides, a conductor being provided in the socket in relation to where each pair of outlet being located, and a switch being provided on the socket respective of each conductor for its relative pair of outlet to control whether the conductor to be conducted or not.

5. A multi-direction insertion socket comprising:

at least one conductor for receiving a plug member inserted in both first and second insertion directions transversely offset one from the other, said conductor having an undulating portion forming at least first and second clamping parts;

each of said clamping parts having a substantially U-shaped sectional contour formed by a pair of opposed clamping tab portions and a curved portion extending therebetween, said first clamping part defining a first channel for receiving a plug member introduced along said first direction, said second clamping part defining a second channel for receiving a plug member introduced along said second direction;

said first and second channels being formed on opposing sides of an intermediately disposed one of said clamping tab portions.

6. The multi-direction insertion socket as recited in claim 5 wherein said conductor terminates at said undulating portion thereof.

7. The multi-direction insertion socket as recited in claim 5 wherein said undulating portion of said conductor describes a substantially S-shaped sectional contour.

* * * * *